United States Patent [19]

Hultgren

[11] Patent Number: 4,511,306

[45] Date of Patent: Apr. 16, 1985

[54] COMBUSTION TURBINE SINGLE AIRFOIL STATOR VANE STRUCTURE

[75] Inventor: Kent G. Hultgren, Swarthmore, Pa.

[73] Assignee: Westinghouse Electric Corp., Pittsburgh, Pa.

[21] Appl. No.: 345,125

[22] Filed: Feb. 2, 1982

[51] Int. Cl.[3] ..... F01D 9/02; F01D 9/04

[52] U.S. Cl. ..... 415/136; 415/190

[58] Field of Search ..... 415/189, 191, 200, 138, 415/139, 134, 135, 136, 190, 137, 187, 188, 193, 208; 416/241 R

[56] References Cited

U.S. PATENT DOCUMENTS

| | | | |
|---|---|---|---|
| 2,497,041 | 2/1950 | Bodger | 415/200 X |
| 2,811,331 | 10/1957 | Wiegand | 415/136 |
| 3,423,071 | 1/1969 | Noren | 415/189 X |
| 3,511,577 | 5/1970 | Karstensen | 415/137 |
| 3,689,174 | 9/1972 | Rahaim et al. | 415/115 |
| 3,728,041 | 4/1973 | Bertelson | 415/189 |
| 3,841,787 | 10/1974 | Scalzo | 415/138 X |
| 4,083,648 | 4/1978 | Asplund | 415/189 X |
| 4,141,127 | 2/1979 | Cretella et al. | 416/241 R X |
| 4,288,201 | 9/1981 | Wilson | 415/136 X |

FOREIGN PATENT DOCUMENTS

| | | | |
|---|---|---|---|
| 1326037 | 6/1962 | France | 415/139 |
| 670734 | 6/1979 | U.S.S.R. | 415/191 |

*Primary Examiner*—John M. Jillions
*Assistant Examiner*—Leo Peters
*Attorney, Agent, or Firm*—E. C. Arenz

[57] ABSTRACT

A one-piece, investment cast stator structure is provided including inner and outer shrouds 14 and 12 with a hollow airfoil-shaped vane therebetween and with areas 34, 36, 42 and 44 in the vicinity of the intersections of the shrouds with the airfoil vane walls being of reduced thickness relative to the remainder of the shrouds to provide improved properties of the material in these areas to better respond to thermal stresses imposed on the structure.

1 Claim, 7 Drawing Figures

COMBUSTION TURBINE SINGLE AIRFOIL STATOR VANE STRUCTURE

BACKGROUND OF THE INVENTION

This invention pertains generally to the art of combustion turbines and in particular to that portion of the art relating to airfoil stator vane structures.

As is well known to those skilled in this art, turbine stator vanes in a combustion turbine work in a very severe environment. The temperatures of the hot combustion gas leaving the combustor baskets in their annular array are not uniform when the gas reaches the first stage stator vanes. Large temperature variations exist in the circumferential direction, as well as in the radial direction. With the typical current design of multiple airfoil vane segments, non-uniform heating of the different airfoils leads to premature creep-fatigue failures of the segments.

Vane segments are produced by the investment casting process. With a multiple airfoil casting, it is difficult to achieve a uniform and controlled solidification of the molten metal. Areas containing porosity and macrosegregation are commonly found in the airfoil-to-shroud intersection vicinity of the multiple airfoil segments. Of couse, these casting defects lower the material low-cycle fatigue and creep properties.

The lowered material properties combined with high thermal strains at the shroud-to-airfoil intersection vicinity have caused premature failures in multiple airfoil segments. The high thermal strains are caused by nonuniform heating and cooling of the redundant multiple airfoil structure. Thus, obviously, the life of the vane segment casting can be increased if the thermal strains are reduced and if the material properties are improved.

It is the aim of this invention to provide an improved structure which reduces structural constraints and discontinuities and in addition improves the mechanical properties of the investment casting in high stress areas.

While my invention proceeds from the basis that the casting will be a single vane segment, as distinct from multiple vanes in a segment, it is acknowledged that the bare concept of the use of single vane segments is disclosed in U.S. Pat. No. 3,689,174. However, my invention includes an arrangement which is structurally different in a number of its aspects and correspondingly is considered to provide advantages relative to an arrangement as shown in the noted patent.

SUMMARY OF THE INVENTION

In accordance with one aspect of the invention, the one-piece investment cast stator structure includes an inner shroud segment, an outer shroud segment, and a single generally hollow, airfoil-shaped stator vane between the segments, with the portions of the shroud segments, in the general vicinity of the intersection between the hollow blade portions of the vane and the shrouds, being of substantially reduced thickness relative to the thickness of the shroud segments along their side margins, so as to provide a relatively closer match in thickness between the vane walls and the reduced thickness portions of the shroud segments so that the material properties of the shroud portion of the vicinity of the intersections are improved in these high stress areas.

Further in accordance with the invention, the stator structure includes upstream and downstream support rail means on the outer shroud segment for connecting the stator structure to blade ring means of the turbine, and the upstream rail means is secured to the blade ring means in a way that restrains relative movement in the circumferential and axial directions while permitting limited relative movement in the radial direction.

DRAWING DESCRIPTION

Figure 6:
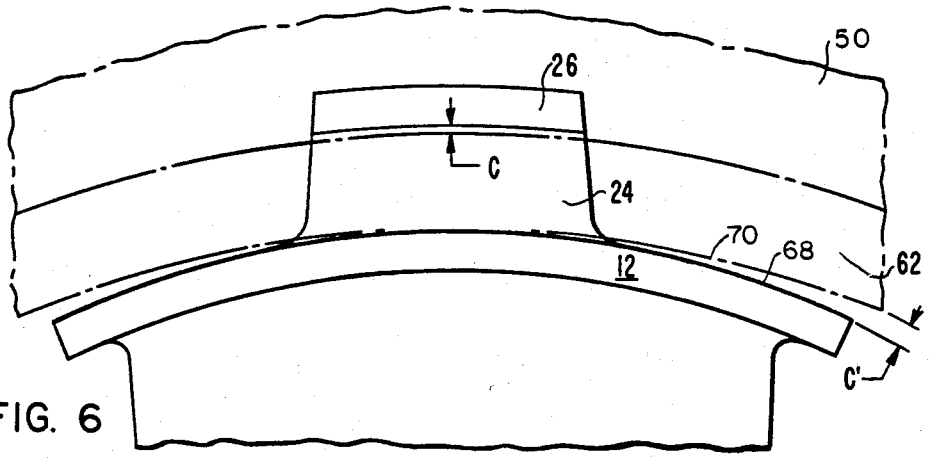
Figure 7:
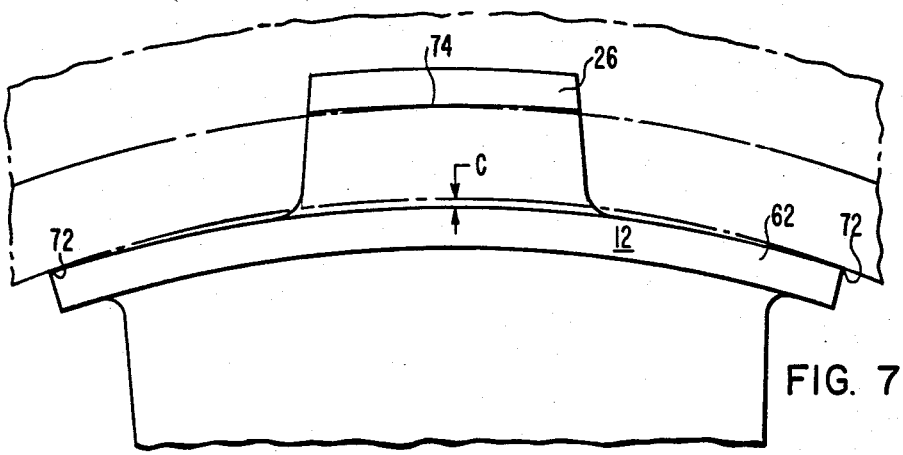

FIG. 6 is an elevation view of a fragmentary portion of the vane segment provided with the downstream support rail or tab and with a fragmentary portion of the isolation segment being shown in phantom, this view being exaggerated in several respects to illustrate variations in clearance dimensions in a cold condition of the turbine; and FIG. 7 is a view similar to FIG. 6, but illustrating the relation of the parts under a hot condition.

DESCRIPTION OF THE PREFERRED EMBODIMENT

Figure 2:
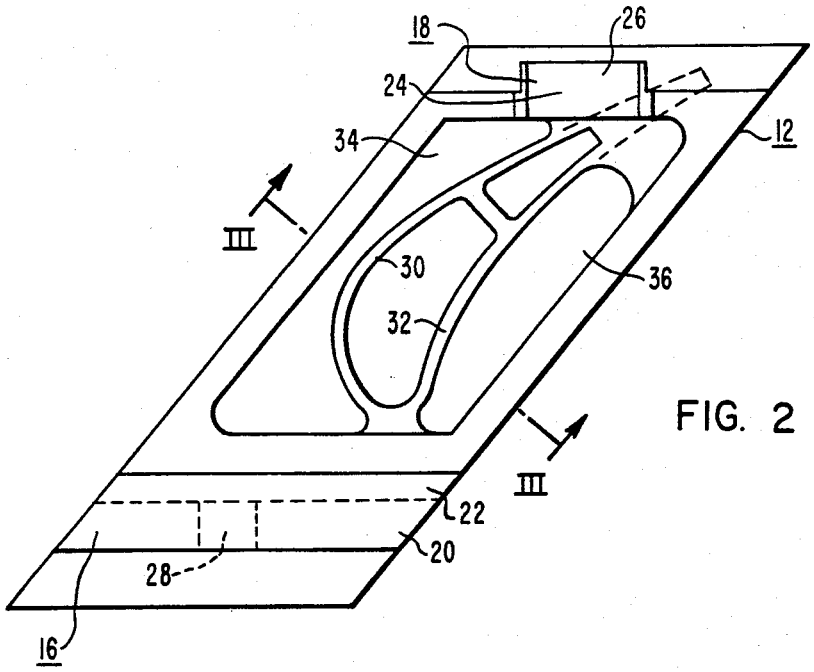
FIG. 2 is a plan view of the segment, looking at the end having the outer shroud.
Figure 1:
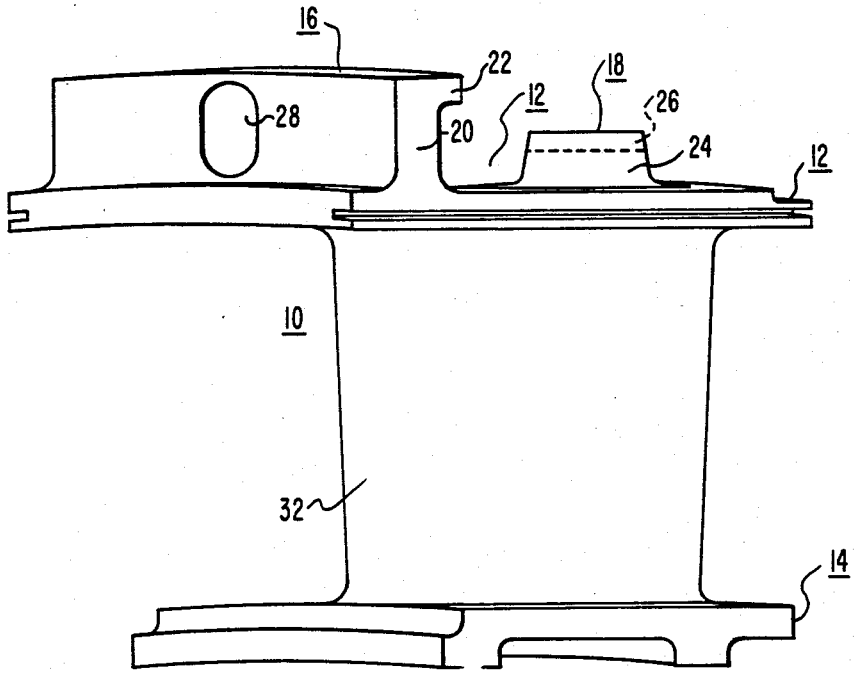
FIG. 1 is a front face elevation view of a single airfoil stator segment according to the invention, this view looking in the direction of the flow past the segment.
Figure 3:
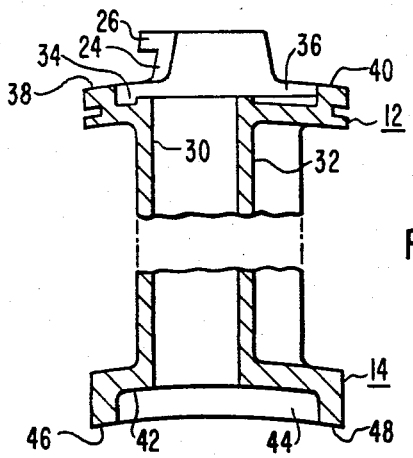
FIG. 3 is a broken, cross-sectional view corresponding to one taken along the line III—III of FIG. 2.

Referring to FIGS. 1–3, a one-piece investment cast structure is shown and includes the generally hollow, single airfoil-shaped vane 10 having its opposite ends integrally joined through the casting procedure to the outer shroud generally designated 12, and the inner shroud generally designated 14. Integrally cast with the outer shroud is an inlet or upstream end support rail generally designated 16 which extends continuously for the width of the outer shroud, and an outlet or downstream end support rail or tab generally designated 18 which extends for only part of the width of the shroud, as is best seen in FIG. 2. The inlet end support rail comprises a stem portion 20 and a downstream projecting flange portion 22 with the outlet end support tab 18 similarly having a stem 24 and a downstream projecting flange 26. The stem 20 is provided with a hole 28 which is elongated in the radial direction, with respect to the disposition of the vane segment in a turbine.

The generally hollow, airfoil-shaped vane 10 (FIG. 2) includes opposite walls throughout its hollow portion, including one wall 30 having a convex outer face and the opposite wall 32 having a concave outer face.

In accordance with one aspect of the invention, the investment casting mold is formed so that the wall thickness of the areas of the shroud in the general vicinity of the intersections between the vane walls and the shroud walls is substantially less than the thickness of the shroud walls at the side margins. This is best seen in FIGS. 2 and 3 in which the reduced thickness areas of the outer shroud 12 are indicated by the numerals 34 and 36 while the greater thickness side margins of the outer shroud are indicated by the numerals 38 and 40. As shown in FIG. 3, the reduced thickness portions of the inner shroud are indicated by the numerals 42 and 44, while the full thickness portions at the margins of the inner shroud are indicated by the numerals 46 and 48.

The approximate ratios of the thicknesses to each other in the currently preferred form of the vane segment is the side margins of the shrouds are about twice as thick as the reduced area thicknesses of the shrouds, while the reduced area thicknesses of the shrouds are approximately twice the thickness of the vane walls 30 and 32.

By virtue of the provision of an investment casting process in which the vane segment has the thicknesses referred to, and by casting the segments with single vanes rather than multiple vanes, even solidification of the casting is promoted and accordingly there is a reduced degree of porosity and macrosegregation of the material in the high thermal stress areas at the intersections of the airfoil vane and shrouds.

As noted heretofore, the invention is premised upon the casting of a single airfoil vane segment as distinct from a multiple airfoil vane segment. In that connection, multiple vane segments are rather complicated structures to cast since the casting must be designed in a manner that the metal will feed and fill all sections. Even with the best casting techniques now available it is difficult to avoid uneven solidification of the multiple vane structure. One reason for this is that the solidification can be better controlled in a single airfoil casting where both the convex and concave sides of the airfoil are exposed to the same cooling air temperature, and are not subject to radiation or lack thereof because of the presence or absence of adjacent airfoils in the multiple vane segments.

Another advantage with the single airfoil segment as distinct from the multiple airfoil segments is that thermal stresses during operation will normally be much lower. This is because in the multiple vane segments the metal temperature varies from airfoil to airfoil and hotter airfoils will "jack" the cooler airfoils apart while the hotter airfoil itself is being strained, such restraints causing large thermal strains. Obviously with a single airfoil segment, the structure is free to expand or contract independently of the adjacent airfoils. It will of course, be appreciated that such advantages occur to any single airfoil segment irrespectively of whether such a segment is provided with the features of the instant invention.

Figure 4:
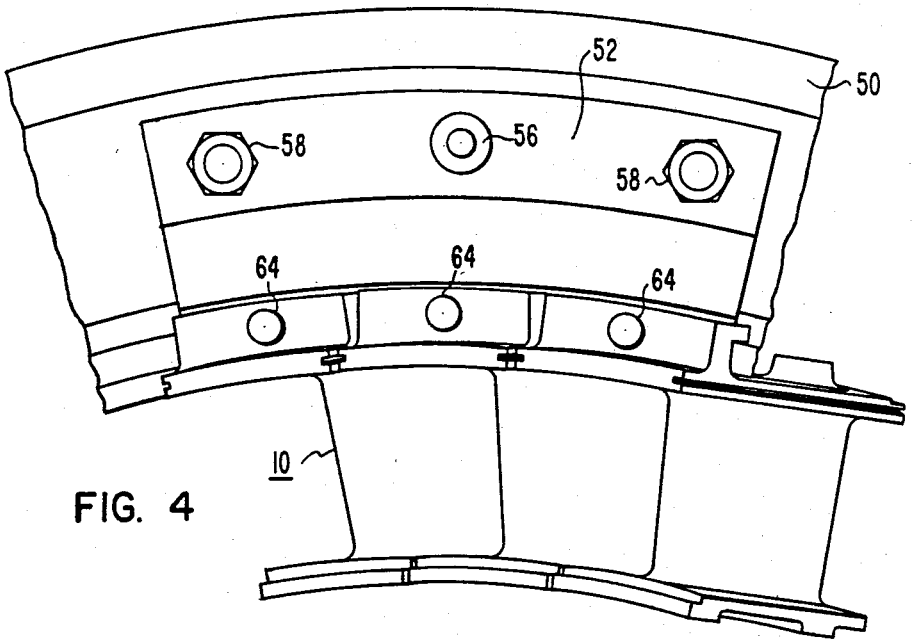
FIG. 4 is an elevation view of a part of the blade ring assembly along with several vane segments secured thereto.
Figure 5:
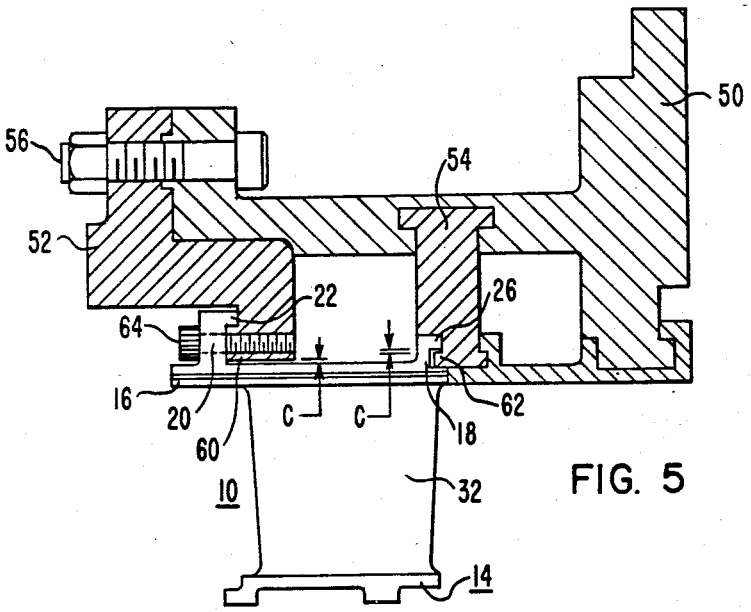
FIG. 5 is a view partly in elevation and partly in section, and looking transverse to the direction of flow past the segment, of the blade ring assembly and a single vane segment assembled thereto.

The stator section of a combustion turbine is made up of two major parts including the blade ring assemblies to which are connected the vane segments in an annular array along the radially inner portion of the blade ring assembly. Referring to FIGS. 4 and 5 the blade ring main portion 50 has a series of blade ring segments 52, each of which is dimensioned to accommodate three individual vane segments, and a series of isolation ring segments 54 (FIG. 5). The upstream blade ring segments 52 include means which will be detailed for receiving and supporting the upstream support rail 16 of the vane segment, while the isolation segments 54 include means, also to be detailed, for supporting the downstream support tabs 18 of the vane segment.

In the currently preferred form, the blade ring segments 52 are secured to the blade ring main portion 50 by a dowel bolt 56 and two other bolts 58 (FIG. 4). As is perhaps best seen in FIG. 4, three single airfoil vane segments are bolted to each blade ring segment, with the gap between the blade ring segments basically lining up with the gap between the vane segments so that no vane segment spans any two blade ring segments. This is considered important with respect to avoiding a condition in which certain clearances would be affected, which clearances will be considered later herein.

As is perhaps best seen in FIG. 5, both of the downstream projecting flanges 22 and 26 of the vane segment structure hook over forwardly projecting flanges 60 and 62 of the blade ring segment 52 and isolation segment 54, respectively. This arrangement provides the basic support for the vane segment structure from the blade ring structure and securement of the vane segment in this general position is accomplished by a locating and clamping screw or bolt 64 which is turned through the radially elongated hole 28 in the stem 20 of the upstream support rail and into an insert (not shown) in the hole in flange 60. The elongated hole and locating screw arrangement permits the segment to have limited movement in the radial direction under thermal stress conditions, but fixes it with respect to movement in the axial and circumferential directions, with respect to the turbine as a whole.

The clearance between the upstream projecting flange 60 and the opposing face of the outer shroud 12 is determined in connection with the length of the elongated hole to permit this movement in the radial direction.

In FIG. 5 the letter C indicates a clearance dimension between a hooking flange 26 of a vane segment and forwardly projecting flange 62 of the isolation segment. In the exaggerated view of FIG. 6, it can be seen that arc 68 of the outer shroud 12 has been machined on a shorter radius than the radius of the facing arc 70 of the flange 62 of isolation segment 56. Thus a clearance indicated C' exists as indicated at the opposite sides of an outer shroud with the facing isolation segment, while a clearance C as indicated exists between the flange 26 and flange 62. These clearances exist when the unit is in a cool condition.

Under operating conditions, the temperature gradients across the thickness of the outer shroud 12 tend to straighten it out and flatten the arc 68 so that the relation of the parts is more as shown in FIG. 7, with contact in the areas 72 at the sides of the shroud, and at 74 between the flange 26 and flange 62. While the clearance C of FIG. 6 should be kept to a minimum so that valuable cooling air is not lost, some clearance is necessary for assembly. The clearance C' of FIG. 6 of course provides relief of stresses generated when the outer shroud distorts due to the temperature gradients across the thickness. In the currently preferred embodiment, the value of C' may be in the range of double or triple the value of the basic clearance C as illustrated in FIGS. 5 and 6.

As is best seen in FIGS. 1 and 2, the upstream support rail 16 extends for the width of the upper shroud 12 while the downstream support tab 18 is relatively limited in its length with respect to the width of the outer shroud 12. This particular arrangement is provided since the upstream support rail is located in an area that is easier to cool than the area where the downstream support tab is located. Thus, there is a smaller temperature difference between the hot and cold side of the shroud at the upstream end and accordingly less structural constraint from temperature imposed stresses.

What we claim is:

1. A one-piece cast stator structure for a fluid turbine, comprising:

an inner shroud segment;

an outer shroud segment;

a single, generally hollow, airfoil-shaped stator vane having one wall with a concave outer face, and an opposite wall with a convex outer face, said vane having opposite radial ends integrally joining said shroud segments through an investment casting process;

said vane walls being of a given thickness throughout its hollow portion;

the wall thickness of at least one of said shroud segments, in the general vicinity of the intersection between said at least one shroud segment and the hollow wall portion of the vane, is of substantially reduced thickness relative to the wall thickness of said at least one shroud segment along its side margins, so as to provide a closer match in thickness between said vane wall given thickness and said reduced thickness than between said given thickness and said shroud side margin thickness;

upstream and downstream support rail means on the outer face of said outer shroud segment for connecting said stator sturcture to blade ring means;

means for securing said upstream rail means to said blade ring means to restrain relative movement in the circumferential and axial directions while permitting limited relative movement in the radial direction;

said blade ring means includes groove means receiving said downstream rail means, and said groove means and rail means are dimensioned to provide one clearance permitting limited relative movement therebetween in a radial direction; and the downstream end of said outer shroud carrying said downstream rail has an arc on its portion facing said blade ring means of a shorter radius than the radius of said facing blade ring means to provide another clearance at the circumferential ends of said outer shroud in the order of two to three times larger than said one clearance.

* * * * *